US008186673B2

(12) United States Patent
Michels

(10) Patent No.: US 8,186,673 B2
(45) Date of Patent: May 29, 2012

(54) OPTIMISED GUIDANCE OF DOCUMENTS IN SELF-SERVICE SYSTEMS

(75) Inventor: Andre Michels, Borgentreich-Grosseneder (DE)

(73) Assignee: Wincor Nixdorf International GmbH (DE)

( * ) Notice: Subject to any disclaimer, the term of this patent is extended or adjusted under 35 U.S.C. 154(b) by 255 days.

(21) Appl. No.: 12/527,351

(22) PCT Filed: Apr. 11, 2008

(86) PCT No.: PCT/EP2008/002860
§ 371 (c)(1),
(2), (4) Date: Aug. 14, 2009

(87) PCT Pub. No.: WO2008/138439
PCT Pub. Date: Nov. 20, 2008

(65) Prior Publication Data

US 2010/0072220 A1 Mar. 25, 2010

(30) Foreign Application Priority Data

May 14, 2007 (DE) ..... 10 2007 022 556

(51) Int. Cl.
*B65H 31/00* (2006.01)

(52) U.S. Cl. ..... 271/209; 271/3.01; 271/161; 242/528

(58) Field of Classification Search ..... 271/209, 271/161, 3.01, 3.14, 188; 242/528
See application file for complete search history.

(56) References Cited

U.S. PATENT DOCUMENTS

| | | | | |
|---|---|---|---|---|
| 4,249,552 | A | 2/1981 | Margolin et al. | |
| 5,947,463 | A * | 9/1999 | Honegger | 271/3.01 |
| 6,296,242 | B1 * | 10/2001 | Saltsov et al. | 271/3.21 |
| 6,568,154 | B1 | 5/2003 | Lundblad et al. | |
| 2003/0116400 | A1 | 6/2003 | Saltsov et al. | |
| 2003/0155704 | A1 | 8/2003 | Polidoro et al. | |

FOREIGN PATENT DOCUMENTS

| | | | |
|---|---|---|---|
| EP | 1321408 | A1 | 6/2003 |
| WO | WO-03030107 | A2 | 4/2003 |

* cited by examiner

*Primary Examiner* — Jeremy R Severson
(74) *Attorney, Agent, or Firm* — Harness, Dickey & Pierce, P.L.C.

(57) ABSTRACT

A roller storage system for storing sheet-type objects, in particular bank notes, is proposed, comprising a first film drum (3), which can be rotatably driven by a motor, with a first strip-shaped film (7) as a storage strip, comprising a second film drum (4), which can be rotatably driven by a motor, with a second strip-shaped film (11) as a cover strip, and comprising a winding drum (1), which can be rotatably driven by a motor. The films (7, 11), for the reception of the sheet-type objects (20), can be wound from the two film drums (3, 4) onto the winding drum (1) and, for the dispensing of the sheet-type objects (20), can be wound from the winding drum (1) onto the two film drums (3, 4). A first deviating roller (9) between the first film drum (3) and the winding drum (1) serves for the diversion of the first film (7). A second deviating roller (13) between the second film drum (4) and the winding drum (1) serves for the diversion of the second film (11). The second deviating roller (13) is here arranged offset relative to the first deviating roller (9) in the direction of transport of the films (7, 11).

26 Claims, 7 Drawing Sheets

OPTIMISED GUIDANCE OF DOCUMENTS IN SELF-SERVICE SYSTEMS

FIELD

Figure 1:
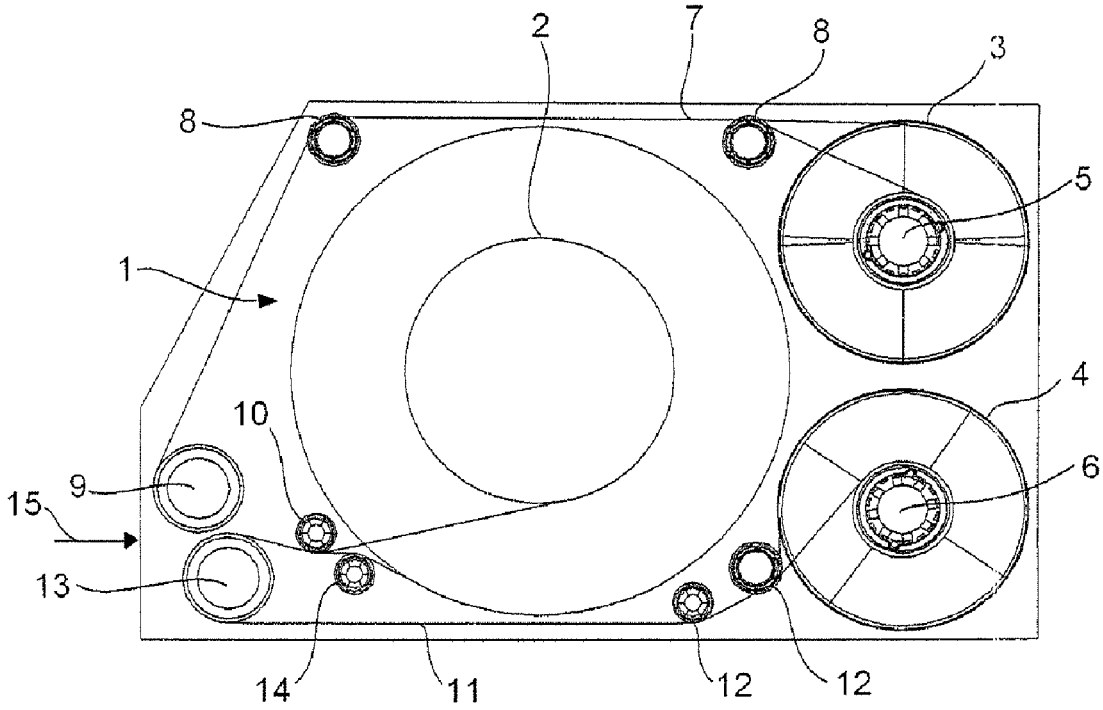

The invention is based on a roller storage system for storing sheet-type objects, especially bank notes, between the winding layers of two sheet-type films which are spooled back and forth between a first and a second film drum, on the one hand, and a winding drum, on the other hand.

BACKGROUND

Roller storage systems are used, in addition to cassette storage systems, in automated teller machines, cashbox systems and other money processing systems, such as, for example, automatic cash desk vaults and money recycling systems. Roller storage systems allow bank notes to be deposited and dispensed in a quick and simple manner. When deposits are made into the roller storage system or the roller storage system is filled, the bank notes are successively wound onto the winding drum between the winding layers of one or two films. In a first variant of a roller storage system having just one storage strip, the bank notes are held between the winding layers of a strip-shaped film serving as a storage strip. In a second variant, in addition to the first film, a second strip-shaped film, serving as a cover strip, is provided. For the first and second film, a first and a second film drum are arranged spatially separate from each other in the roller storage system. The two films are brought together via a respective deviating roller. At the deviating rollers, the sheet-type objects, when deposited, are introduced between the films and, when dispensed, are withdrawn from the films. Leaving the deviating rollers, the two films are fed, lying one upon the other, to the winding drum. The sheet-type objects are thus held between the first and the second film. The present roller storage system is here constituted by a roller storage system of the second variant.

For the dispensing of the sheet-type objects, the films are wound off from the winding drum and wound onto the film drums. In this operation, the sheet-type objects are released from the winding layers and can be successively withdrawn. The dispensing of the sheet-type objects is thus realized according to the "last in", "first out" principle.

Since the depositing and dispensing of the sheet-type objects is realized automatically and at high speed, it is of crucial importance that the sheet-type objects are guided and held by the films in a reliable manner. If a sheet-type object becomes wholly or partially detached from the films during transport, then this leads to a jam in the roller storage system, with the result that the apparatus has then to be opened manually and the cause of the jam removed. For this, operation of depositing or dispensing the sheet-type elements must be interrupted.

SUMMARY

The object of the present invention is to provide a roller storage system which allows a reliable guidance of the sheet-type objects between the films, so that the risk of unwanted detachment of objects from the film guide is minimized.

The roller storage system according to the invention and having the features of claim 1 has the advantage over roller storage systems known from the prior art that the first deviating roller assigned to the first film and the second deviating roller assigned to the second film are mutually offset in the direction of transport. The two films are arranged one behind the other with respect to the film transport direction prevailing between the deviating rollers and the winding roller. This means that, both in the depositing and in the dispensing operation, a sheet-type object passes first the one and then the other deviating roller with its, in the direction of transport, front edge. The path length and the period for which the edge of an object is at least indirectly in contact with one of the two deviating rollers is dependent on the distance over which the first and second film are in direct or indirect contact with the deviating roller. In the portion between the winding drum and the deviating roller arranged closest to the winding drum, the first and second film lie adjacent to each other. An object is indirectly in contact with a deviating roller when it is separated from the deviating roller only by one of the two films and the other film is pressing it against the deviating roller. A film is indirectly in contact with a deviating roller when it is separated from the deviating roller only by the other film and, where appropriate, an object.

The two deviating rollers are arranged offset in such a way that the two films, having passed the deviating roller situated closest to the winding drum, lie closely adjacent to each other. This is achieved either by a minimal distance between the two offset deviating rollers, or by a change of direction of the film travel between the first and second deviating roller, on the one hand, and the deviating rollers and the winding drum, on the other hand. In the second case, the distance between the two deviating rollers can be greater than the minimum distance in the first case. The maximum distance between the two deviating rollers is limited by the overall size of the roller storage system and the length of the sheet-type objects. Advantageously, the distance between the deviating rollers should not be greater than the length of the sheet-type objects, measured in the direction of transport.

The sheet-type objects are taken up, during transport from the winding drum to the deviating rollers, first by one and then by the other deviating roller. The path over which a guided and reliable transport of the objects is realized is greater with an offset arrangement of the deviating rollers than if the deviating rollers are arranged at the same position in the direction of transport. This allows a reliable transport of the objects between the deviating rollers and the winding drum. An unwanted detachment of the objects from the films can thereby be prevented.

Since the two films between the two deviating rollers and the winding drum lie adjacent to each other, a force is applied to the objects arranged between the films insofar as at least one of the two films is in contact with one of the two deviating rollers. The film facing away from this deviating roller is drawn, due to the film guide, likewise in the direction of the deviating roller. The object arranged between the films is clamped reliably in place.

The deviating rollers, in addition to their above-described positioning, can also be arranged offset with respect to the document feed-in and the document feed-out. This depends on the direction of the document feed-in and of the document feed-out. This direction is predefined, in the depositing operation, by a document guide arranged in front of the deviating rollers and, in the dispensing operation, by a document guide arranged after the deviating rollers. If the direction is consistent with the perpendicular bisectors of the connecting paths of the axes of the two deviating rollers, then the sheet-type objects, when documents are fed in, are simultaneously taken up by both deviating rollers. Similarly, the objects, when documents are fed out, are simultaneously released by both deviating rollers. In this case, no offset is present. If, however, the direction of the document guidance differs from the perpendicular bisectors of the connecting paths of the axes of the two deviating rollers, then the deviating rollers are offset also relative to the document feed-in and/or the document feed-out. In this case, the sheet-type objects, when documents are fed in, are taken up first by one and then by the other deviating roller. Correspondingly, the sheet-type objects, when documents are fed out, are released first by one and then by the other deviating roller.

When the sheet-type objects are deposited and dispensed in the horizontal direction, the offset arrangement of the first and second deviating roller is obtained by virtue of the position of the axis of the first deviating roller lying outside a vertical plane running through the axis of the second deviating roller. If the depositing and dispensing of the sheet-type objects takes place in the vertical direction, then an offset arrangement of the first and second deviating roller is obtained by virtue of the position of the axis of the first deviating roller lying outside a horizontal plane running through the axis of the second deviating roller.

Advantageously, the two deviating rollers, despite the offset, have a minimum distance apart to ensure that the two films are brought close together by the deviating rollers and the sheet-type objects are held between the films. The offset of the axis of the second deviating roller relative to the first deviating roller is therefore preferably realized on a circle, the center point of which forms the axis of the first deviating roller. The radius of this circle corresponds to the sum of the radii of the two deviating rollers and the minimum distance apart. This is predefined, for example, by the sum of the thicknesses of the first and second film and double the thickness of the sheet-type objects. To this, a tolerance range of 20% can be added.

According to an advantageous embodiment of the invention, the offset between the first and second deviating roller is less than the length of the sheet-type objects, measured in the direction of transport. The distance apart of the two deviating rollers is chosen sufficiently small in the direction of transport of the films that the sheet-like objects, over a certain distance of the transport path, are simultaneously taken up by both deviating rollers. If the sheet-type objects are supplied and withdrawn in the horizontal direction, this means that the distance between the axis of the first deviating roller and the vertical plane running through the axis of the second deviating roller is less than the length of the sheet-type objects, measured in the direction of transport. That end of the sheet-type object which is situated at the rear in the direction of transport is thus only released by one deviating roller once the front-situated end of the sheet-type object in the direction of transport is taken up by the other deviating roller. This leads to a reliable document guidance by two deviating rollers over the distance between the two deviating rollers, and by at least one deviating roller over a correspondingly greater distance.

According to one advantageous embodiment of the invention, the two deviating rollers have the same diameter. The offset between the first deviating roller and the second deviating roller here amounts to at least 25% of the diameter of the deviating rollers. From this value, the offset between the two deviating rollers is large enough for the above-stated positive effects to make themselves felt.

According to one advantageous embodiment of the invention, the two deviating rollers have the same diameter. The offset between the first deviating roller and the second deviating roller here amounts to no more than 40% of the diameter of the deviating rollers. In principle, the offset can also be further enlarged. The document feed-in in the horizontal direction, when the objects are introduced between the two deviating rollers, is then however made more difficult, and the overall size of the roller storage system is possibly over-enlarged.

According to a further advantageous embodiment of the invention, at least a first back-up roller is arranged between the two deviating rollers and the winding drum. The guidance of the films, and of the objects between the films, is thereby further improved. Advantageously, the back-up roller is arranged in such a way relative to the two films that the films undergo a change of direction as a result of the back-up roller. The first plane, which is predefined by the course of the films between the two deviating rollers and the back-up roller, and the second plane, which is predefined by the course of the film between the back-up roller and the winding drum, intersect at an angle different than 0° and 180°. Upon the change of direction, the two films are pressed against the back-up roller and the objects are clamped reliably in place between the films.

According to a further advantageous embodiment of the invention, a second back-up roller is arranged between the first back-up roller and the winding drum such that it is offset relative to the first back-up roller in the direction of transport of the films. As a result of the offset arrangement of a second back-up roller, the objects arranged between the films are subjected to an additional force which fixes the objects in their position relative to the films and thus prevents detachment of the objects from the films. The objects cannot slide out between the films. This increases the reliability of the transport. Furthermore, the offset arrangement of two back-up rollers means that the front edge of a sheet-type object first passes one and, with time stagger, the other back-up roller. In this way, the distance over which at least one of the two back-up rollers applies a force to the sheet-type objects is enlarged. The sheet-type objects are thus, between the two deviating rollers and the winding drum, in continuous contact with a deviating roller or a back-up roller. The partial or complete detachment of the sheet-type objects from the films, resulting in a change of position of the objects relative to the films in the portion between the deviating roller and the winding roller, is thereby precluded.

In the case of a horizontal document feed-in, the offset of the two back-up rollers results in the distance between the axis of the first back-up roller and a horizontal plane running through the axis of the second back-up roller being less than the sum of the radii of the first and second back-up roller. The offset of the first back-up roller relative to the nearest placed deviating roller results in the distance between the axis of the first back-up roller and a horizontal plane running through the axis of the second deviating roller being less than the sum of the radii of the second deviating roller and the first back-up roller.

According to a further advantageous embodiment of the invention, the back-up rollers have a smaller diameter than the deviating rollers. The back-up rollers can thereby be arranged particularly close to the winding drum.

A reliable guidance of the objects up to the winding drum and a small overall size of the roller storage system is hereby made possible.

According to a further advantageous embodiment of the invention, on the axis of the first and/or of the second deviating roller, at an axial distance to the deviating roller, at least one disk is arranged, the radius of which is greater than the radius of the deviating roller. During transport, the disk applies a force to the sheet-type object and ensures deflection of a region of the sheet-type object. If both deviating rollers are equipped with such a disk on different sides, then the two disks do not get in the way of each other. During its transport through the two deviating rollers, the sheet-type object acquires a wave shape. The deformation of the sheet-type object has a positive effect upon the reliability of the transport. In a preferred manner, the diameter of a disk is maximally 40% greater than the diameter of the adjacent deviating roller. Particular preference is for a diameter which is between 1 and 10% greater than the diameter of the deviating roller.

According to a further advantageous embodiment of the invention, the disk has a soft, rubbery surface. As a result of this surface, the friction between the sheet-type object and the disk is intensified and the take-up of the object is optimized. Despite the high friction coefficient, the material of the surface must have a certain hardness so that it is not or only slightly deformed in the guidance of the sheet-type objects. The disk can be constituted, for example, by a timing disk for determining the rotation speed of the deviating roller. This is equipped with openings in the radial direction.

According to a further advantageous embodiment of the invention, the axes of the first and second film drum, of the winding drum and of the first deviating roller are arranged fixedly on a housing. The axis of the second deviating roller is arranged fixedly on a deviating roller housing part, which is held on the housing rotatably about an axis. This deviating roller housing part has the advantage that the second deviating roller can be moved apart from the first deviating roller in order to remedy a jam in the roller storage system. In this way, folded sheet-type objects, which obstruct the transport in the roller storage system, can be quickly and easily removed. On the housing, an end stop can be provided to limit the included angle between the first and the second deviating roller. The housing or the deviating roller housing part can be equipped with a locking lever, which locks the deviating roller housing part in the closed setting. The locking lever encompasses, in the closed setting, a locking bolt. The imaginary or real axis, about which the deviating roller housing part is rotatable, is advantageously located between the deviating rollers and the winding drum in order to be able to reach as far as possible into the region between the deviating rollers and the winding drum when the deviating roller housing part is open. Insofar as the roller storage system is equipped with back-up rollers in addition to the deviating rollers, in an advantageous embodiment of the invention one of the two back-up rollers is disposed fixedly on the housing and the other back-up roller on the deviating roller housing part.

According to a further advantageous embodiment of the invention, the housing and/or the deviating roller housing part is/are equipped with guide elements, which are arranged in a funnel shape. These are preferably located between the back-up rollers and the side wall of the housing. They result in a folded-over region of a sheet-type object being straightened out during transport between the deviating rollers and the winding drum. A jam in the roller storage system which has been triggered by folded-over regions can thereby be prevented and a folded object can be converted into an unfolded state.

According to a further advantageous embodiment of the invention, the roller storage system is equipped with a U-shaped light guide. Both ends of the U-shaped light guide extend up to the axis of one of the two deviating rollers.

They are oriented, for the coupling-in and coupling-out of light, in the direction of the respectively other deviating roller. Close to the axis of the other deviating roller, opposite to the ends of the U-shaped light guide, a light source and a light-sensitive sensor are arranged. The position of the U-shaped light guide should here be chosen such that the two ends of the U-shaped light guide are covered neither by the first, nor by the second film. A covering of one or both ends of the U-shaped light guide takes place only insofar as a sheet-type object is being led through between the two deviating rollers. If the light-sensitive sensor receives no light from the light source, then it is concluded that a sheet-type object is present between the two deviating rollers. Only once the sheet-type object has fully passed the two deviating rollers are both ends of the U-shaped light guide released and the sensor again receives light from the light source. In this way, the sheet-type objects wound onto the winding drum or wound off from the winding drum can be counted when passing the deviating rollers. The proximity of the ends of the U-shaped light guide to the axes of the two deviating rollers guarantees a small overall size of the roller storage system, as well as the detection of the sheet-type objects guided past the deviating roller.

According to a further advantageous embodiment of the invention, the roller storage system is equipped with two first films serving as storage strips and with two second films serving as cover strips. For this purpose, two first film drums and two second film drums are disposed on the roller storage system. The two first films can be arranged side by side on a common axis. The equivalent applies to the two second film drums. Each film receives a corresponding guide, so that two first deviating rollers, two second deviating rollers, and a corresponding number of back-up rollers are provided. The greater number of films has the advantage that the sheet-type objects are held not just in one region, but in two regions, by the mutually adjacent films, and that each of the films, as well as the deviating rollers and back-up rollers, can have a smaller width than in the case of just one film pair.

Further advantages and advantageous embodiments of the invention can be derived from the following description, the drawing and the claims.

DRAWINGS

Figure 2:
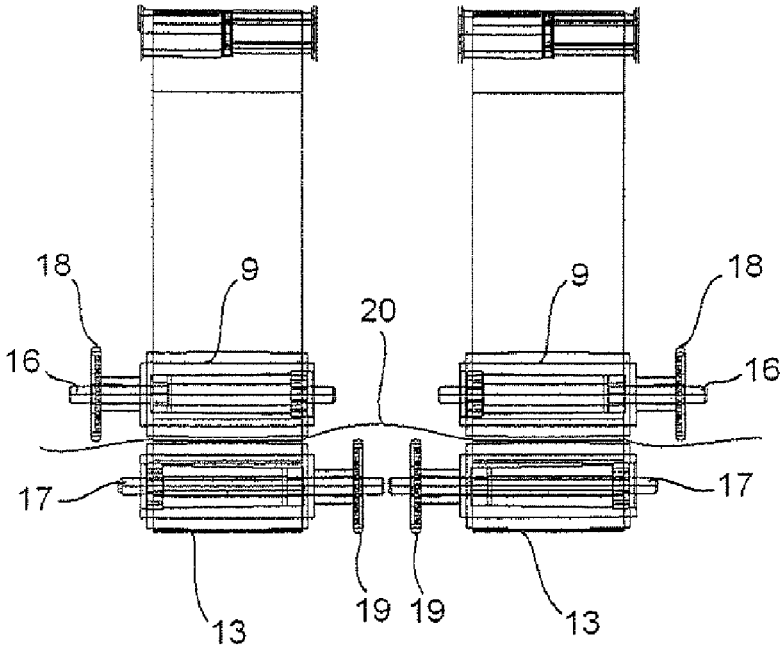
Figure 3:
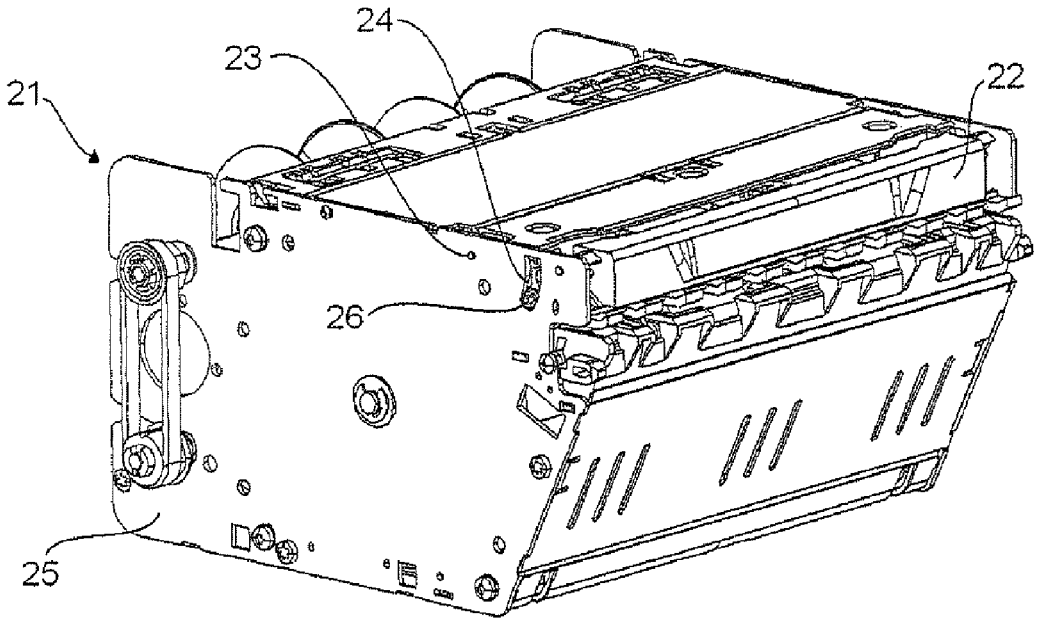
Figure 4:
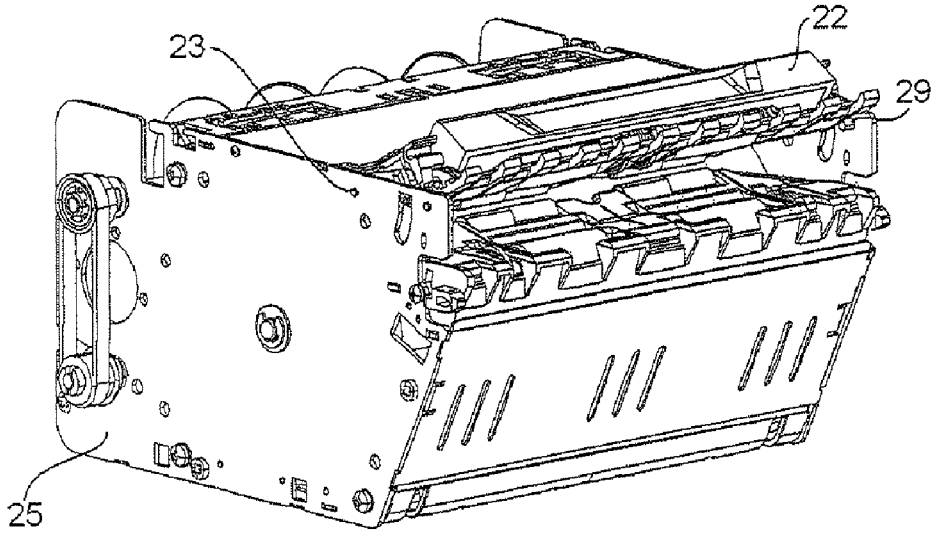
Figure 5:
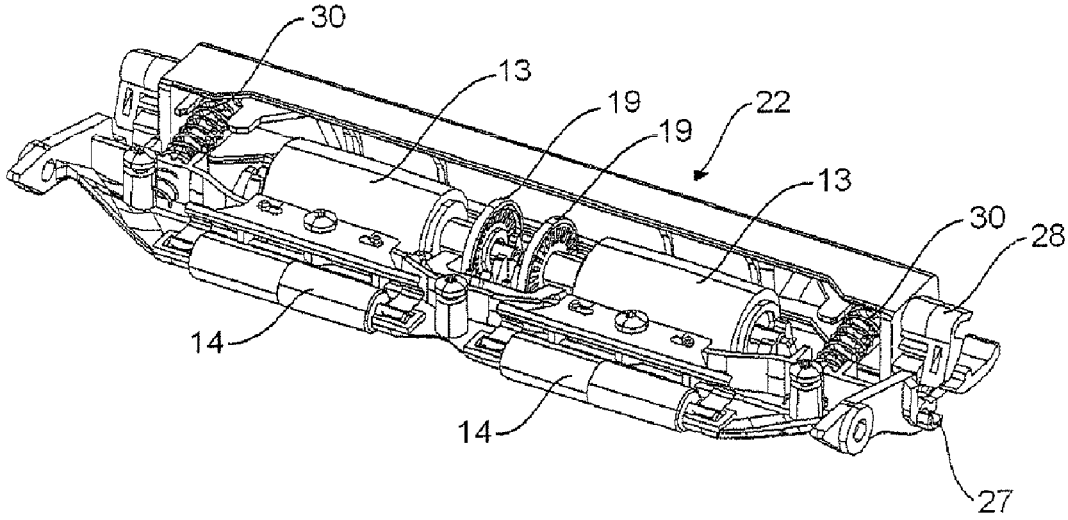
Figure 6:
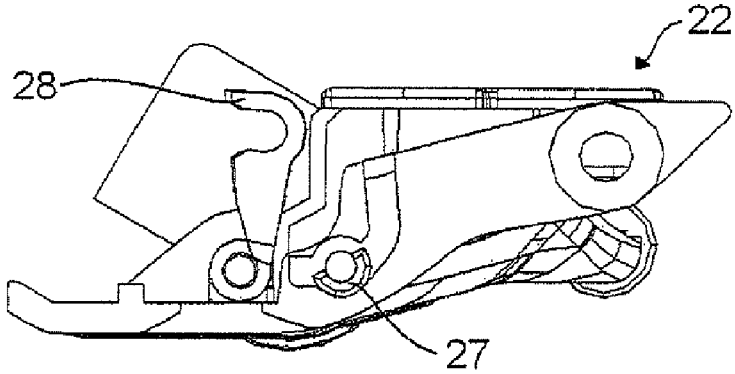
Figure 7:
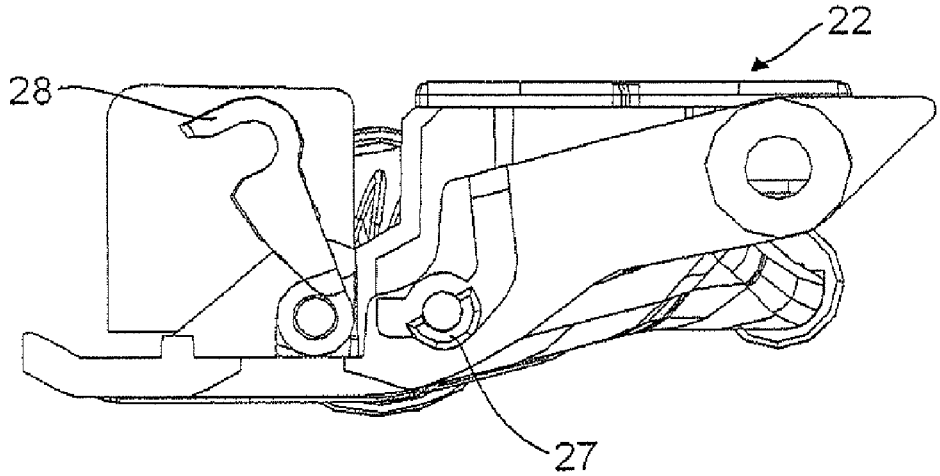
Figure 8:
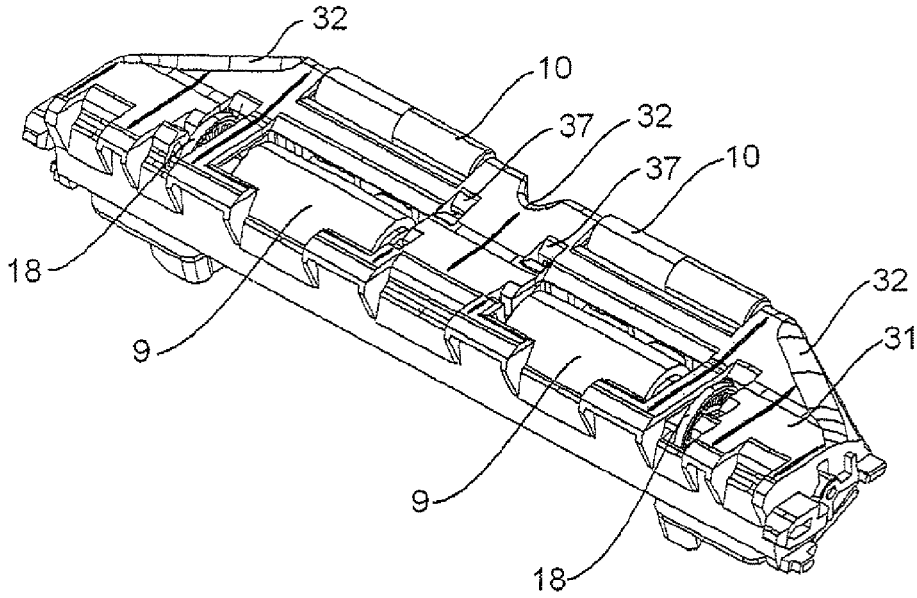
Figure 9:
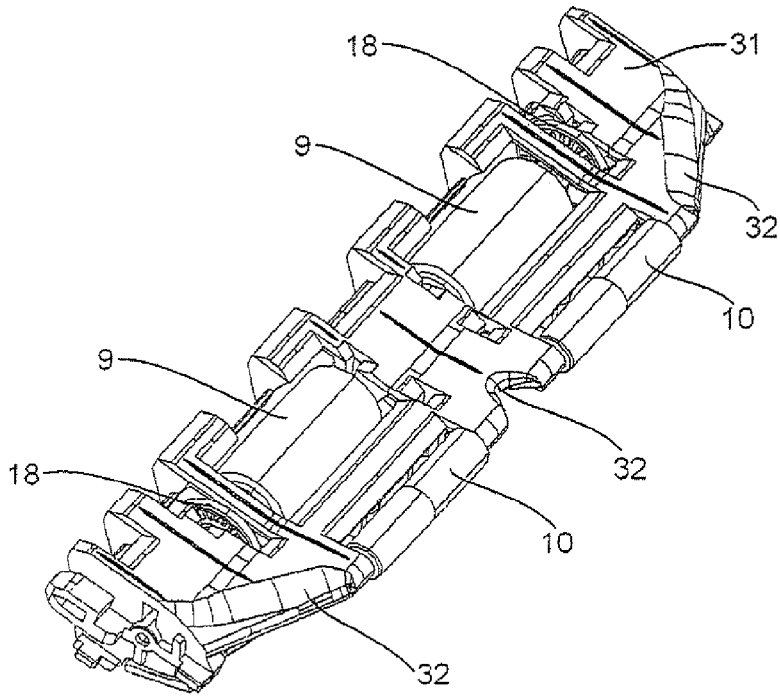
Figure 10:
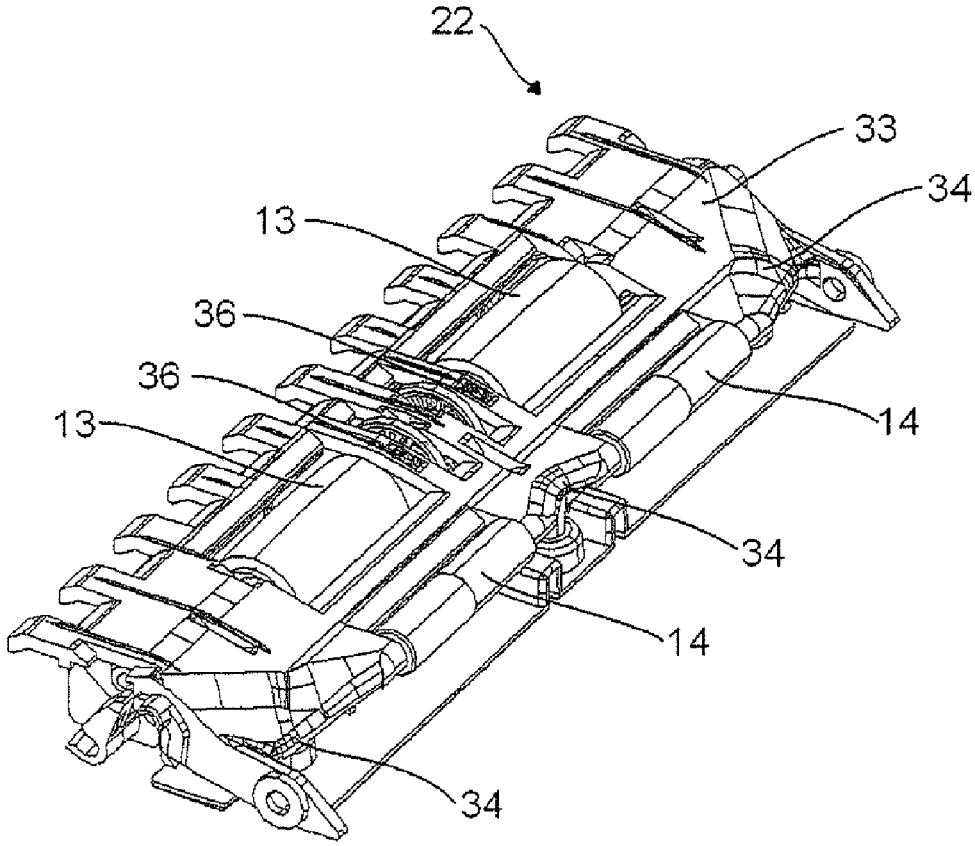
Figure 11:
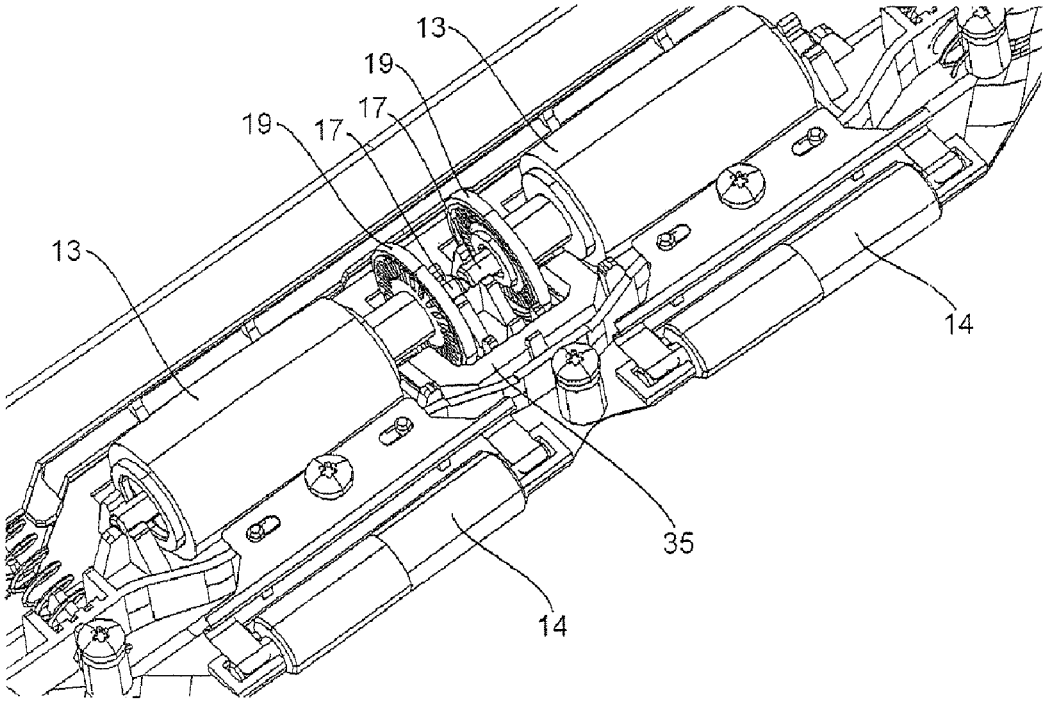

An illustrative embodiment of the invention is represented in the drawing, wherein:

FIG. 1 shows a schematic representation of a roller storage system in side view, FIG. 2 shows a view of the deviating rollers and of the back-up rollers of the roller storage system according to FIG. 1 in a view from the front, FIG. 3 shows a perspective view of the roller storage system according to FIG. 1, with closed deviating roller housing part, FIG. 4 shows a roller storage system according to FIG. 3 with open deviating roller housing part, FIG. 5 shows a deviating roller housing part in a view from below, FIG. 6 shows a deviating roller housing part in side view, with open locking lever, FIG. 7 shows a deviating roller housing part with closed locking lever, FIG. 8 shows part of the roller storage system in perspective view, FIG. 9 shows part of the roller storage system in perspective view, FIG. 10 shows a deviating roller housing part in perspective view with funnel-shaped document guide, FIG. 11 shows a detail from FIG. 5, deviating rollers with disks and U-shaped light guide.

DETAILED DESCRIPTION

In FIG. 1, a roller storage system is shown in simplified representation in a side view, with open housing. In the middle is located a winding drum 1 having a winding core 2. The outer circle around the winding core 2 indicates the periphery of the winding drum 1 in the filled state. To the left of the winding drum 1, two first film drums 3 and two second film drums 4 are represented. The two first film drums 3 are arranged axially side by side on the axis 5. The two second film drums 4 are arranged axially side by side on the axis 6. Since the direction of view in FIG. 1 corresponds to the orientation of the axes 5 and 6, in FIG. 1 only that film drum which is facing the viewer is visible. The two first film drums 3 are fixedly connected to the axis 5, which is rotatably driven by a motor (not represented in the drawing). The equivalent applies to the two second film drums 4 and the axis 6. Onto each of the two first film drums 3 is wound a first film 7, which is guided, via two guide rollers 8, a first deviating roller 9 and a back-up roller 10, to the winding drum 1. Exactly like the two first film drums 3, the two first films 7, the guide rollers 8, the two deviating rollers 9 and the two back-up rollers 10 are arranged side by side, so that in FIG. 1 only one of the said rollers is in each case visible to the viewer. Onto the two second film drums 4 there is respectively wound a second film 11, which second films are fed, via the guide rollers 12, a second deviating roller 13 and a second back-up roller 14, to the winding drum 1. The axes of the winding drum 1, of the first film drums 3, of the second film drums 4, of the guide rollers 8 and 12, of the deviating rollers 9 and 13, and of the back-up rollers 10 and 14 run parallel. At the two deviating rollers 9 and 13, the first films 7 and the second films 11 are brought together, so that they lie closely adjacent to each other. In the portion between the two deviating rollers 9 and 13 and the winding drum 1, a first film 7 lies respectively on a second film 11. The document feed-in of sheet-type objects (not represented in FIG. 1) takes place in the horizontal direction according to the arrow marked with the numeral 15 in FIG. 1. An apparatus serving to guide the document to the document feed-in is not represented in the drawing. The sheet-type objects arriving at the two deviating rollers 9 and 13 are first taken up by the first film, which is guided via the first deviating roller 9, and then fed to the second film, which is guided around the second deviating roller 13. This time-staggered contacting of the first and second deviating roller 9 and 13 is realized on the basis of an offset between the two deviating rollers. In FIG. 1, this offset is indicated by two parallel lines emanating from the axes of the deviating rollers 9 and 13. From the second deviating roller 13, the first and second films 7 and 11 are pressed one against the other and the sheet-type objects arranged between them are held. Due to the force which the two deviating rollers 9 and 13, as well as the two back-up rollers 10 and 14, apply to the first and second film, and thus to the sheet-type objects between the films, as well as the friction existing between the sheet-shaped objects and the films, the position of the sheet-shaped objects relative to the films is maintained from the two deviating rollers 9 and 13 up to the winding drum 1. As soon as the objects are on the winding drum, their position, given sufficient tensioning of the films, no longer changes. Between the two deviating rollers 9 and 13 and the winding drum 1, the two films 7 and 11, as well as the sheet-shaped objects arranged between them, undergo several changes of direction by virtue of the two back-up rollers 10 and 14. Due to these changes of direction, additional forces are applied to the two films and to the sheet-shaped objects arranged between them. The distance between the two deviating rollers 9 and 13, the first back-up roller 10, the second back-up roller 14 and the winding drum 1 is chosen such that even the smallest sheet-type object, between the first deviating roller 9 and the winding drum 1, is always in contact with at least one deviating roller or at least one back-up roller. The films are not only guided tangentially past the two deviating rollers 9 and 13, as well as the two deviating rollers 10 and 14, but are diverted into another direction, whereby the contact between film and deviating roller, as well as between film and back-up roller, is made over a larger film portion and the applied force is increased.

The document feed-out is realized by the two films 7 and 11 being wound, via the two back-up rollers 10 and 14, the two deviating rollers 9 and 13 and the guide rollers 8 and 12, onto the film drums 3 and 4. The sheet-type objects are dispensed between the two deviating rollers 9 and 13 in the horizontal direction oppositely to the arrow 15.

FIG. 2 shows the two first deviating rollers 9 and the two second deviating rollers 13 in a view from the front. The direction of view here corresponds to the document feed-in marked with an arrow in FIG. 1. Each of the deviating rollers 9 and 13 is mounted rotatably about an axis 16 and 17. At an axial distance to the two first deviating rollers 9, a disk 18 is respectively arranged, on the side facing away from the respectively other first deviating roller, rotatably on the axis 16. A spacer (not visible in the drawing) here ensures that the distance between the first deviating rollers 9 and the disks 18 remains constant. Corresponding disks 19 are disposed on the axes 17 of the second deviating rollers 13. Unlike the disks 18, the disks 19 are positioned between the two second deviating rollers. The diameter of the two disks 18 and 19 is greater than the diameter of the first and second deviating rollers 9 and 13. This results in a sheet-type object 20, in its transport between the first and second deviating rollers 9 and 13, undergoing a sinuous or wavy deformation as a result of the disks 18 and 19. This deflection of the sheet-type object 20 is represented in FIG. 2. The sheet-shaped object is curved by the disks downward in the middle between the deviating rollers 9 and 13 and upward at the sides.

FIGS. 3 and 4 show the roller storage system with housing 21 in perspective view. The document feed-in takes place in the direction of the arrow marked with the reference numeral 15 in FIG. 3. The first deviating rollers 9 are visible in the representation according to FIGS. 3 and 4. On a deviating roller housing part 22 arranged rotatably on the housing 1, the second deviating rollers 13 and the second back-up rollers 14 are disposed. The axes of all other elements of the roller storage system are arranged fixedly in the housing 1. The deviating roller housing part 22 is rotatable about the axis 23. Two recesses 24 in the side walls 25 of the housing form a stop for a pin 26 on the deviating roller housing part and thus delimit the included angle of the deviating roller housing part 22. By opening the deviating roller housing part 22, it is possible to reach into the region of the first and second deviating rollers 9 and 13 and of the first and second back-up rollers 10 and 14. In this way, jammed documents are able to be removed from the region.

FIGS. 5, 6 and 7 show the deviating roller housing part 22 in various views. Engaging in the receiving fixtures 27 is an axle journal (not visible in the drawing) disposed on the side walls 25 of the housing 21. A locking lever 28 disposed on the side of the deviating roller housing part 22 encompasses, in the closed setting, a locking bolt 29 on the side walls 25 of the housing 21. The locking is supported by the compression springs 30. The locking lever 28 is visible in FIG. 4.

FIGS. 8 and 9 show a detail from the roller storage system, comprising the two first deviating rollers 9, the two first back-up rollers 10 and the two disks 18. These parts are surrounded by a document guide 31 having guide elements, which, on the sides and in the middle between the back-up rollers 10, are of funnel-shaped configuration. For this purpose, the document guide is provided both laterally and in the middle with guide elements 32 in the form of indents, which are rounded in the direction of transport. A sheet-type object which is fed onto these indents and whose corners are folded over, or which is lacerated in the middle, is subjected through the edges to a force which leads to the straightening-out of the folded-over corners and to the orientation thereof in the plane of the other sheet-type object.

In FIG. 10, the deviating roller housing part 22 equipped with a corresponding document guide 33 is represented. In the deviating roller housing part 22 also, the document guide 33 has guide elements 34 in the form of indents in the middle between the back-up rollers 14, as well as to the side of the back-up rollers.

These take the form of beveled regions with round edges, which serve the same purpose as described above. In the closed setting of the deviating roller housing part, the guide elements 32 and 34 of the document guides 31 and 33 are arranged opposite each other and form a three-dimensional funnel for the sheet-type objects. Both upwardly and downwardly folded-over regions of the sheet-type objects are thus straightened.

In FIG. 11, the deviating roller housing part 22 is represented without the document guide 33. In this representation can be seen the U-shaped light guide 35, which encompasses the two disks 19 and extends with its two ends up to the axis 17 of the second deviating roller 13. The document guide 33 has two rectangular recesses 36 for the two ends of the U-shaped light guide 35. As a result of these two recesses 36, light is coupled into and coupled out from the ends of the light guide. For this purpose, in the document guide 31, which in the closed setting lies opposite the document guide 32, corresponding recesses 37 are arranged, which are visible in FIGS. 8 and 9. Behind these recesses 37, a light source and a light-sensitive sensor are arranged. These two parts are not represented in the drawing. Via the light source, light is coupled in at one end of the light guide and coupled out at the other end, to allow detection by means of a light-sensitive sensor. The ray path between the light source and the sensor is interrupted if at least one of the two recesses 36 and 37 is covered by a sheet-shaped object transported between the deviating rollers. Based on the interruption of the ray path, a sheet-shaped object is thus detected between the deviating rollers 9 and 13. By virtue of the light guide, both the light source and the sensor can be accommodated in the fixed housing. They do not therefore form a constituent part of the rotatable deviating roller housing part. The wiring is thereby facilitated. As a result of the U-shaped light guide, a light-guidance close to the axes 19 and the two deviating rollers 13 is enabled, despite the two disks 19. This happens in such a tight space that the overall size of the deviating roller housing part is not enlarged by the U-shaped light guide 35.

All features can be fundamental to the invention both individually and in any chosen combination with one another.

The invention claimed is:

1. A roller storage system for storing sheet-type objects, such as, for example, bank notes, comprising a first film drum, which can be rotatably driven by a motor, with a first strip-shaped film as a storage strip, said system comprising:

a second film drum, which can be rotatably driven by a motor, with a second strip-shaped film as a cover strip to hold the sheet-type objects between the first and the second film, a winding drum, which can be rotatably driven by a motor, the films, for the reception of the sheet-type objects, being able to be wound from the two film drums onto the winding drum and, for the dispensing of the sheet-type objects, being able to be wound from the winding drum onto the two film drums, a first deviating roller between the first film drum and the winding drum for diversion of the first film, a second deviating roller between the second film drum and the winding drum for diversion of the second film, a disk arranged within a transport path of the sheet-type objects on an axis of one of the first deviating roller or the second deviating roller, the disk including a radius that is greater than a radius of the first deviating roller and a radius of the second deviating roller, the first and the second film on the first and second deviating roller being brought together and being jointly fed from there to the winding roller, and a position of the second deviating roller being offset relative to the first deviating roller in the direction of transport of the films.

2. The roller storage system as claimed in claim 1, wherein, the offset between the first deviating roller and the second deviating roller is less than the length of the sheet-shaped objects, measured in the direction of transport.

3. The roller storage system as claimed in claim 1, wherein, the two deviating rollers have the same diameter, and in that the offset between the first deviating roller and the second deviating roller amounts to at least 25% of the diameter of the deviating rollers.

4. The roller storage system as claimed in claim 1, wherein, the two deviating rollers have the same diameter, and in that the offset between the first deviating roller and the second deviating roller amounts to no more than 40% of the diameter of the deviating rollers.

5. The roller storage system as claimed in claim 1, wherein, the distance between the two deviating rollers amounts to at least the sum of the thicknesses of the two films and the thickness of the sheet-shaped objects, and to no more than the sum of the thicknesses of the two films and three times the thickness of the sheet-type objects.

6. The roller storage system as claimed in claim 1, wherein, between the winding drum and the two deviating rollers, at least one back-up roller is arranged.

7. The roller storage system as claimed in claim 6, wherein, the direction of the course of the films between the first back-up roller and the deviating roller arranged closest to the first back-up roller is different than the direction of the course of the films between the first back-up roller and the winding drum.

8. The roller storage system as claimed in claim 6, wherein, between the first back-up roller and the winding drum, a second-back-up roller is arranged offset to the first back-up roller in the direction of transport of the films.

9. The roller storage system as claimed in claim 8, wherein, the second back-up roller is arranged on that side of the films which is facing away from the first back-up roller.

10. The roller storage system as claimed in claim 8, wherein, the direction of the course of the films between the first back-up roller and the deviating roller arranged closest to the first back-up roller is different than the direction of the course of the films between the first and second back-up roller.

11. The roller storage system as claimed in claim 6, wherein, the axis of at least one of the back-up rollers is disposed on the deviating roller housing part.

12. The roller storage system as claimed in claim 1, wherein the disk is a timing disk for determining the rotation speed of the deviating roller, and the timing disk is equipped with a soft, rubbery surface.

13. The roller storage system as claimed in claim 1, wherein, the axes of the first and second film drums, of the winding drum and of the first deviating roller are arranged fixedly on a housing, in that the axis of the second deviating roller is arranged fixedly on a deviating roller housing part, and in that the deviating roller housing part is arranged on the housing rotatably about an axis.

14. The roller storage system as claimed in claim 13, wherein, the housing or the deviating roller housing part is equipped with a locking lever, which locks the deviating roller housing part in a closed setting.

15. The roller storage system as claimed in claim 14, wherein, the locking lever is acted upon by at least one compression spring.

16. The roller storage system as claimed in claim 13, wherein, the housing and/or the deviating roller housing part is/are equipped with guide elements for the sheet-type objects, and in that that guide elements are arranged in a funnel shape.

17. The roller storage system as claimed in claim 1, wherein, it is equipped with a U-shaped light guide, both ends of which extend up to the axis of one of the two deviating rollers, in that both ends of the U-shaped light guide are oriented, for the coupling-in and coupling-out of light, in the direction of the respectively other deviating roller, and in that close to the axis of the other deviating roller, opposite to the ends of the U-shaped light guide, a light source and a light-sensitive sensor are arranged.

18. The roller storage system as claimed in claim 17 wherein, the U-shaped light guide is arranged between the two first and the two second deviating rollers.

19. The roller storage system as claimed in claim 1, wherein, it is equipped with two first film drums and/or two second film drums, and/or with two first deviating rollers and/or with two second deviating rollers.

20. The roller storage system of claim 1, wherein the disk includes a pair of disks arranged between a pair of the first deviating rollers or a pair of the second deviating rollers.

21. The roller storage system as claimed in claim 20, wherein, a U-shaped light guide encompasses the two disks, and in that the two ends of the U-shaped light guide extend respectively between a disk and a deviating roller up to the axis of the deviating roller.

22. The roller storage system as claimed in claim 1, wherein the disk includes a pair of disks arranged on outward sides of a pair of the first deviating rollers or a pair of the second deviating rollers.

23. The roller storage system as claimed in claim 1, wherein, between the deviating rollers and the winding drum, two first back-up rollers are rotatably arranged.

24. The roller storage system as claimed in claim 23, wherein, between the two first back-up rollers and the winding drum, two second back-up rollers are rotatably arranged.

25. A roller storage system for storing sheet-type objects including bank notes comprising:

a rotatable first film drum including a first film;

a rotatable second film drum including a second film, the first and the second films configured to hold the sheet-type objects therebetween;

a winding drum rotatable in a first direction to wind the first film, the second film, and sheet-type objects therebetween onto the winding drum, the winding drum rotatable in a second direction to unwind the first film, the second film, and sheet-type objects therebetween off of the winding drum;

a first deviating roller between the first film drum and the winding drum for diversion of the first film, the first deviating roller rotatable about a first deviating roller axis;

a second deviating roller between the second film drum and the winding drum for diversion of the second film, the second deviating roller rotatable about a second deviating roller axis; and a disk arranged within a transport path of the sheet-type objects on one of the first deviating roller axis or the second deviating roller axis, the disk including a radius that is greater than each of a radius of the first deviating roller and a radius of the second deviating roller;

wherein the first film passes over the first deviating roller and the second film passes over the second deviating roller, the first film converges with the second film between the first and the second deviating rollers and the winding roller; and wherein the second deviating roller is offset from the first deviating roller in a direction of transport of the first and the second films.

26. A roller storage system for storing sheet-type objects including bank notes comprising:

a rotatable first film drum including a first film;

a rotatable second film drum including a second film, the first and the second films configured to hold the sheet-type objects therebetween;

a winding drum rotatable in a first direction to wind the first film, the second film, and sheet-type objects therebetween onto the winding drum, the winding drum rotatable in a second direction to unwind the first film, the second film, and sheet-type objects therebetween off of the winding drum;

a first deviating roller between the first film drum and the winding drum for diversion of the first film, the first deviating roller rotatable about a first deviating roller axis;

a second deviating roller between the second film drum and the winding drum for diversion of the second film, the second deviating roller rotatable about a second deviating roller axis; and a first disk and a second disk both arranged within a transport path of the sheet-type objects, the first disk on the axis of the first deviating roller and the second disk on the axis of the second deviating roller, each of the first disk and the second disk include a radius that is greater than a radius of the first deviating roller and a radius of the second deviating roller, the first disk is arranged on a first side of the first and the second deviating rollers and the second disk is arranged on a second side of the first and the second deviating rollers that is opposite to the first side;

wherein the first film passes over the first deviating roller and the second film passes over the second deviating roller, the first film converges with the second film between the first and the second deviating rollers and the winding roller; and wherein the second deviating roller is offset from the first deviating roller in a direction of transport of the first and the second films.

* * * * *